United States Patent [19]

Agarwal et al.

[11] Patent Number: 4,986,529

[45] Date of Patent: Jan. 22, 1991

[54] FOUR ROLL INVERTER

[75] Inventors: Vinod K. Agarwal, Webster, N.Y.; Barry M. Dixon, Herts, England; Joseph C. Foerster, Webster; Gregory G. Jones, Rochester, both of N.Y.

[73] Assignee: Xerox Corporation, Stamford, Conn.

[21] Appl. No.: 258,944

[22] Filed: Oct. 17, 1988

[51] Int. Cl.[5] ..... B65H 29/60

[52] U.S. Cl. ..... 271/291; 271/303; 271/186; 271/219; 271/902

[58] Field of Search ..... 271/184, 185, 186, 225, 271/902, 65, 291, 303, 219, 224, 272

[56] References Cited

U.S. PATENT DOCUMENTS

| | | | |
|---|---|---|---|
| 2,484,196 | 10/1949 | Turrall et al. | 271/303 X |
| 4,078,789 | 3/1978 | Kittredge | 271/65 |
| 4,238,126 | 12/1980 | Langdon | 271/902 X |
| 4,277,061 | 7/1981 | Nagel et al. | 271/303 X |
| 4,359,217 | 11/1982 | Roller et al. | 271/186 |
| 4,385,825 | 5/1983 | Kaneko | 355/35 H |
| 4,441,704 | 4/1984 | Uchida et al. | 271/303 |
| 4,487,506 | 12/1984 | Repp | 355/14 SH |
| 4,512,255 | 4/1985 | Crist | 271/186 X |
| 4,673,176 | 6/1987 | Schenk | 271/186 |
| 4,699,367 | 10/1987 | Russel | 271/65 |
| 4,735,409 | 4/1988 | Brown | 271/186 |

OTHER PUBLICATIONS

IBM Technical Disclosure Bulletin, P. S. Bach, "Sheet Inverter", vol. 18, No. 3, Aug. 1975, pp. 628 and 629.

Xerox Disclosure Journal, George J. Roller, "Constant Force Spring Inverter", vol. 8, No. 2, Mar./Apr., 1983, p. 101.

*Primary Examiner*—Andres Kashnikow
*Assistant Examiner*—K. DeRosa
*Attorney, Agent, or Firm*—William A. Henry, II

[57] ABSTRACT

A tri-directional inverter for use in machines requiring copy sheet inversion for collated copy set output uses four rollers forming three sheet-feeding nips. All sheets enter the center nip and contact a diverter gate that urges them in either of two directions. The sheets are corrugated by corrugating rollers as they enter a spring loaded inversion channel. The spring and corrugation rollers urge the sheets back out of the inversion channel into engagement with either of the selected other nips formed by the four rollers for feeding back into the machine for further processing.

20 Claims, 2 Drawing Sheets

FOUR ROLL INVERTER

Figure 1:
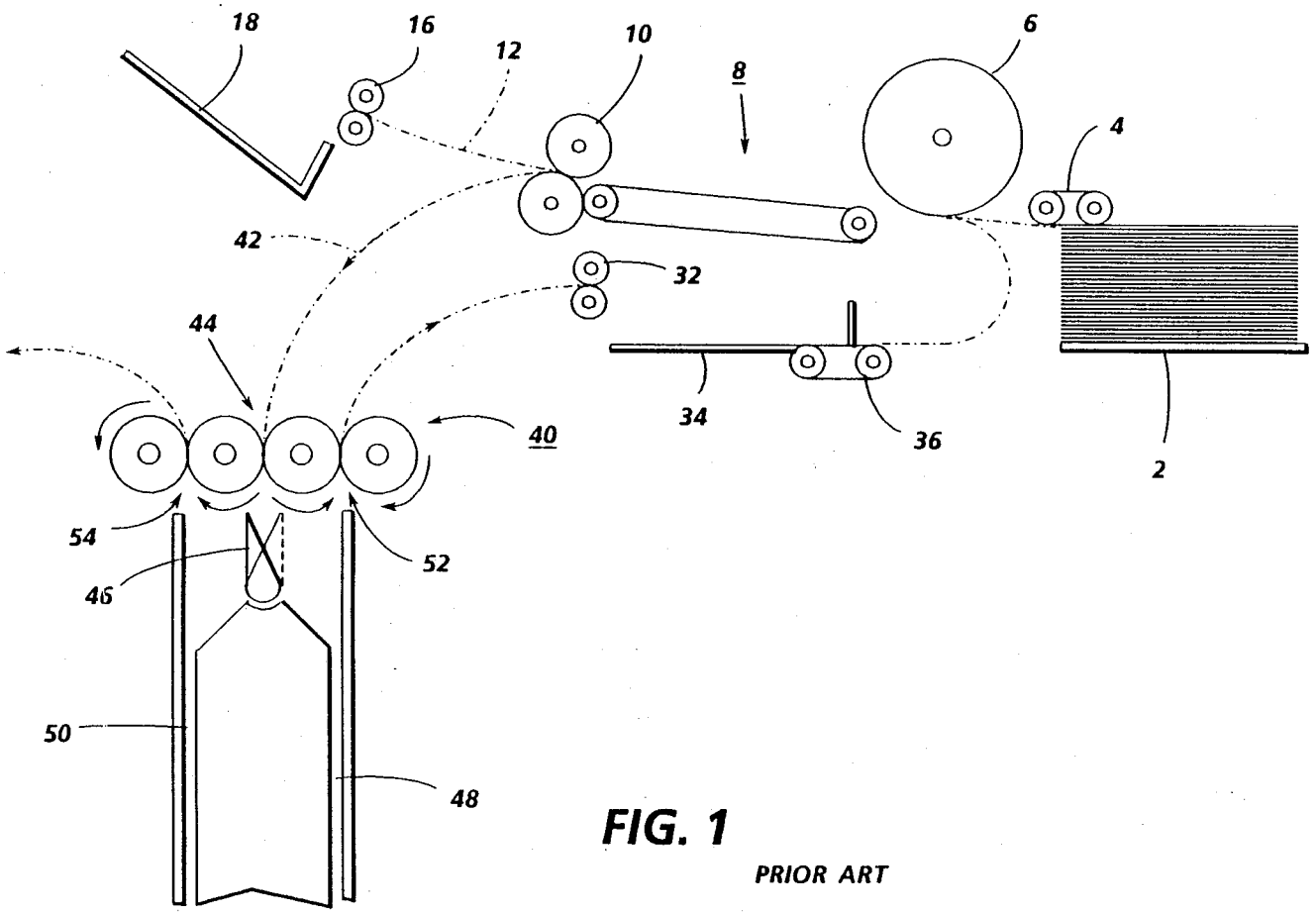
FIG. 1 PRIOR ART

This invention is directed to an apparatus for changing the orientation of a copy sheet. More particularly, the invention is directed to a four roll inverter that includes a spring loaded inversion channel.

In the field of reprographic machines, it is often necessary to feed along one of two alternative paths a copy sheet leaving the processor of the machine, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feeds it back into the processor, but inverted, so that the appropriate data can be applied to the second side of the sheet. One known sheet-feeder (USPN 4,359,217) for effecting this includes three rollers in frictional or geared contact with each other, to provide two spaced-apart nips, one being an input nip to an associated downstream sheet pocket, and the other being an output nip for extracting each sheet from the pocket.

Other known copy sheet inverters include USPN 4,487,506; 4,078,789; and 4,385,825. All of the patents show tri-roll inverters that are used to feed copy sheets into and out of a chute for inversion purposes. A sheet turnaround device is disclosed in IBM Technical Disclosure Bulletin, Vol. 18, No. 3, Aug. 1975, Page 628, that changes the leading edge of a sheet while subjecting the sheet to harmonic motion reversing, all the while continuously engaging the surface of the sheet with a drive means. Another known sheet feeder is USPN 4,735,409 which shows an inverter that employs four rolls that form three sheet-feeding nips. All sheets enter the central nip and on leaving it they are selectively diverted into one or the other of two sheet pockets. From the pockets, the sheets bounce or are otherwise fed back into an aligned other nip. Sheets passing through one outer nip may be fed to an output tray, while those passing through the other nip may go back into the machine for further processing. A tri-roll paper inverter that includes a constant force spring in the back of an inverter chute is disclosed in Xerox Disclosure Journal Publication, Vol. 8, Number 2, March/April, Page 101, 1983, In U.S. Pat. No. 4,673,176,an inverter for a copier machine is shown that includes a tri-roll inverting mechanism. A sheet turn over mechanism is disclosed in U.S. Pat. No. 4,699,367 that includes a three-roller cluster and a pair of diverters in the paper travel path.

Accordingly, the present invention aims at providing an inverter designed to have both simplex and duplex sheets fed to it along a common input path into a pocket at least partially surrounded by a low-rate linear compression spring, from which the sheets are extracted and fed along one of two different output paths. A corrugator could be placed along the input path if desired.

Figure 2:
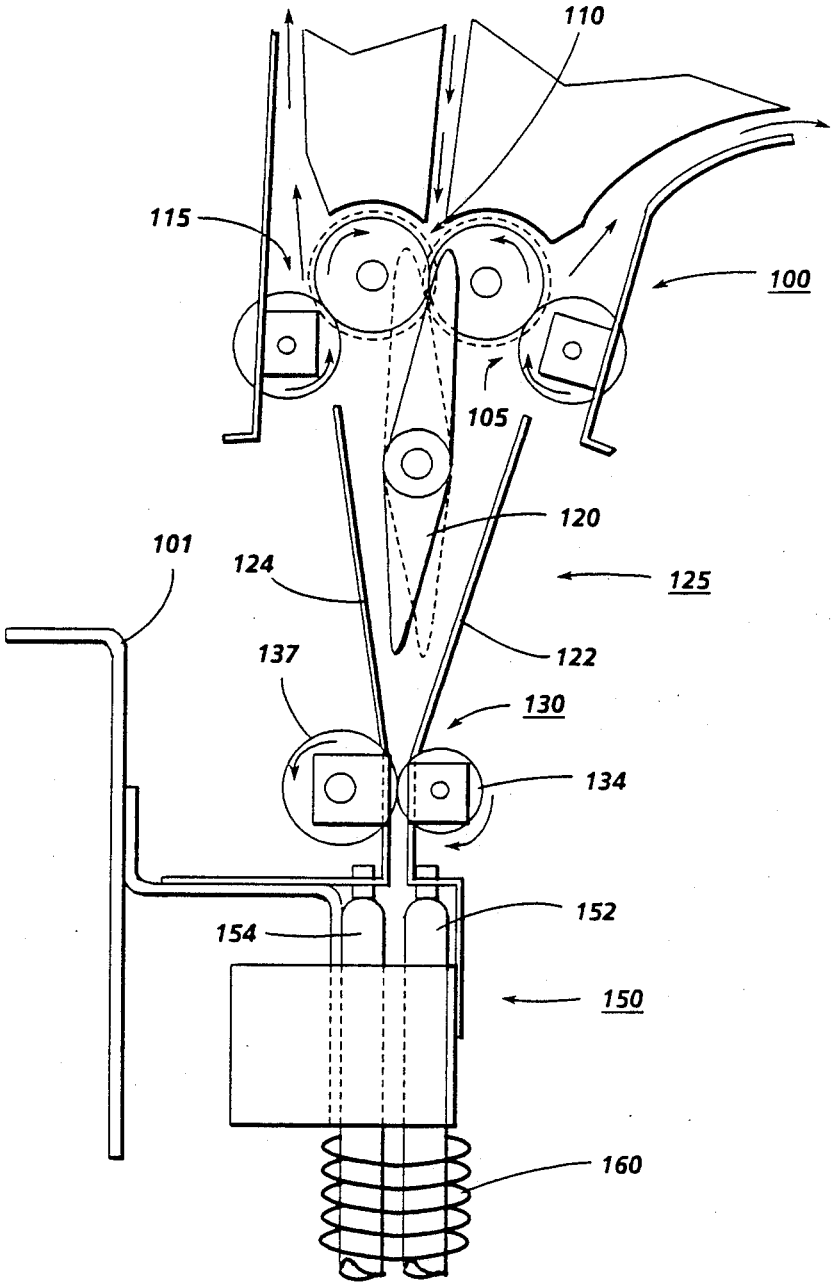

The present invention will now be described by way of example with reference to the accompanying drawing, in which:

FIG. 1 is a diagrammatic view of a reprographic machine incorporating a four-roll sheet inverter, and FIG. 2 is a diagrammatic side view of the four-roll sheet-inverter of the present invention that employs a low-rate compression spring The known apparatus shown in FIG. 1 consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown herein the form of a drum, although it could equally be a belt), from which a particulate material (toner) designed to present a visual contrast with the material of the sheet is transferred from the surface of the photoreceptor to the upper face of the respective sheet. After the sheet with the toner image held on it by electrostatic attraction has been detached from the photoreceptor 6, it is conveyed by a conveyor 8 to a fuser 10, which fuses the toner into a permanent bond with the material forming the sheet, by the application of heat and/or pressure.

On leaving the fuser, the sheet contacts a diverter (not shown) which deflects the sheet so that it moves along one of two paths 12 and 42. Path 12 is an output path, which leads to a feeder 16 ejecting each finished sheet into an output tray 18. A sheet deflected along path 42 passes to the input nip 44 of a four-roll sheet inverter generally referenced 40. In the sheet-feeder 40, not only can simplex copies be inverted prior to their delivery to a buffer tray, but also duplex copies may be reinverted prior to delivery to an output tray, as well as simplex copies being inverted prior to delivery to a sorter which requires image-side-down copy orientation to ensure correct copy set collation. In most machines employing tri-roll inverters, it is often necessary to run all the original sheets through a counting, non-copying, cycle when the production of duplex copies has been chosen by the machine operator, in order to enable the machine to go through the alternative sequences when the number is odd or even. The necessity to go through this counting cycle (also known as 'slewing') wastes time and reduces the productivity of the machine and operator. In the sheet-feeder 40 both duplex and simplex copy sheets from the processor are fed along path 42 to a common input nip 44. On leaving the nip, each sheet has its lead edge contacted by a diverter 46 pivoted to one or other of its limit positions. In the position shown in solid lines, the sheet is diverted into the right-hand pocket 48. Alternatively, when the diverter is in the position shown in broken lines, the respective sheet is diverted into the left-hand pocket 50. As already known, each pocket is provided with sheet-reversing means, so that after entering pocket 48, each sheet is forced upwardly so that it enters the right-hand nip 52, from which the sheet passes through feeder 32 to a buffer tray 34 where each sheet is engaged by a bottom-mounted feeder 36 which is effective to extract the sheet from tray 34 and turn it through a sufficient angle for its remaining blank side to come into contract with photoreceptor 6 in the manner similar to that described above in connection with FIG. 1. Likewise, each sheet fed into pocket 50 is forced upwardly so that its new lead edge becomes engaged by the left-hand nip 54, which is effective to feed the sheet to an output tray.

The improved four roll inverter 100 of the present invention in FIG. 2 includes a central input nip 110 and two exit nips 105 and 115. A diverter 120 is positioned with a pointed end thereof extending upstream of input nip 110 and is adapted to deflect sheets against either sides 122 or 124 of inversion channel 125. Diverter 120 is rotatably actuable by a conventional solenoid to move from the solid line position to the dotted line position as desired depending on whether a sheet is to travel out of the inversion channel to output tray 18 or to a location within the machine for further processing. Input nip 110 drives sheets into corrugation nip 130 that includes reverse rotating retard rolls 134 and 137 that are positioned downstream of diverter 120 and within the inversion channel 125. The drive force of the input nip on each sheet is greater than the reverse drive force of the reverse rotating retard corrugation nip 130 and propels each sheet through two 8 mm steel rods 150 formed by side members 152 and 154 mounted on bracket 101 and running parallel and spaced 3 mm apart or into a series of hollow split tubes (not shown). A soft linear compression spring 160 surrounds a portion of the rod pair or each hollow tube and acts as a backstop for the sheets. It appears that the lead edge of each sheet always stays below the local buckling load. The backstop assembly including at least one hollow split tube and a compression spring is assembled such that the tube guides both the spring and the sheets. The outside diameter of the spring is about 1 mm larger than the tube outside diameter to avoid the possibility of the spring locking on the tube when the sheet strikes the spring off-center. The narrow confinement experienced by the sheet as it moves through the guide space of the hollow split tubes or rods has the effect of temporarily increasing the stiffness of the sheet and thus its buckling strength. Even then, it is somewhat surprising that with the spring acting as the sole backstop for sheets entering the inversion channel no sheet damage has been observed across all ranges of paper weights and sizes.

After a sheet leaves input nip 110, it is urged back out of the inversion channel by spring 160 and driven by reverse rotating retard corrugation nip 130 toward either output nip 115 or nip 105 depending on which position diverter 120 is in at that time. If diverter 105 is in the dotted line position, nip 115 then captures the sheet and drives it toward output tray 18. However, if diverter 120 is in the solid line position nip 105 receives the sheet from corrugation nip 130 and transports the sheet toward duplex tray 34 for continued processing within the machine.

It will be appreciated that an inverter apparatus has been disclosed that includes a four roll inverter in which a sheet is fed into the middle of the assembly and from which it can be fed out in two different directions/branches depending on the copying requirement. For example, the inverter allows copying of 1 to N simplex documents into collated sets and N to 1 copying of simplex documents into duplex sets without document precount. Improved sheet control is obtained with the use of a spring loaded inversion channel that confines the sheet in a narrow space which enhances the range of paper weights and sizes that the inverter is capable of handling.

What is claimed is:

1. An inverter apparatus for handling multiple sized sheets, including four rollers providing three sheet-feeder nips; a solenoid-actuated diverter having a portion thereof position upstream of the center nip, a single sheet pocket comprising at least one partially split tubular member into which sheets can pass after having contacted said diverter, a corrugation nip positioned downstream of said diverter, and a low-rate linear compression spring surrounding a portion of said sheet pocket for urging the sheets back towards either of said two other nips.

2. The inverter apparatus as claimed in claim 1, wherein the direction of motion of each sheet is automatically reversed after it has been fully positioned in said pocket, whereby the former trail edge becomes the new lead edge and enters the aligned nip, which proceeds to extract the sheet from said pocket.

3. The inverter apparatus of claim 2, in which said three sheet-feeder nips comprise four rollers which are of the same diameter, and have their axes lying in the same plane.

4. The inverter apparatus of claim 3, in which said diverter takes the form of a flap pivoted at a position remote from said center nip, and having its free end positioned close to the exit of said center nip, and wherein said pocket of the inverter apparatus includes a portion thereof having inclined surfaces downstream of said diverter to lead the lead edge of each sheet deflected by said diverter into the pocket.

5. The inverter apparatus of claim 4, wherein said pockets comprises at least one partially split tubular member into which each sheet is inserted.

6. An inverter apparatus, including at least two sheet-feeder nips; a solenoid-actuated diverter having a pivot point thereof positioned downstream of said nips; a single sheet pocket comprising at least one partially split tubular member into which sheets can pass after having contacted said diverter; a corrugation nip positioned downstream of said diverter; and a low-rate linear compression spring means surrounding a portion of said sheet pocket for urging the sheets back towards either of said at least two sheet-feeder nips.

7. The inverter apparatus of claim 6, wherein a portion of said diverter is positioned upstream of said nips.

8. The inverter apparatus of claim 6, wherein said sheet pocket comprises at least one partially split tubular member into which each sheet is inserted.

9. An inverter apparatus, including at least two sheet-feeder nips; diverter means having a pivot point thereof positioned downstream of said nips; a single sheet pocket comprising at least one partially split tubular member into which sheets can pass after having contacted said diverter means; and a low-rate linear compression spring means surrounding a portion of said sheet pocket for urging the sheets back towards either of said at least two nips.

10. The inverter apparatus of claim 9, including a corrugation nip positioned downstream of said diverter means.

11. The inverter apparatus of claim 10, wherein a portion of said diverter means is positioned upstream of said at least two sheet-feeder nips.

12. The inverter apparatus of claim 9, wherein said sheet pocket comprises at least one partially split tubular member into which each sheet is inserted.

13. A tri-directional inverter apparatus, including at least three sheet-feeder nips; diverter means having a pivot point thereof positioned downstream of said nips; a single sheet pocket comprising at least one partially split tubular member into which sheets can pass after having contacted said diverter means; and a low-rate linear compression spring means surrounding a portion of said sheet pocket for urging the sheets back towards a selected one of said nips.

14. The tri-directional inverter apparatus of claim 13, including a corrugation nip positioned downstream of said diverter means.

15. The inverter apparatus of claim 14, wherein a portion of said diverter means is positioned upstream of the center of said at least three sheet-feeder nips.

16. An inverter apparatus, including four rollers providing three sheet-feeder nips; a solenoid-actuated diverter having a portion thereof positioned upstream of the center nip, at least two rods forming a single sheet pocket into which sheets can pass after having contacted said diverter, a corrugation nip positioned downstream of said diverter, and a low-rate linear compression spring surrounding a portion of said sheet pocket for urging the sheets back towards a selected one of said nips.

17. An inverter apparatus, including four rollers providing three sheet-feeder nips; a solenoid-actuated diverter having a portion thereof positioned upstream of the center nip, inversion channel means forming a single sheet pocket comprising at least one partially split tubular member for the passage of sheets thereinto after having contacted said diverter, a corrugation nip positioned downstream of said diverter, and a low-rate linear compression spring surrounding a portion of said inversion channel means for urging the sheets back towards either of said two other nips.

18. An inverter apparatus, including at least two sheet-feeder nips; at least two rods forming a single sheet pocket into which sheets pass; and a low-rate linear compression spring means surrounding a portion of said sheet pocket for urging the sheets back towards either of said at least two nips.

19. An inverter apparatus, including at least two sheet-feeder nips; a solenoid-actuated diverter having a pivot point thereof positioned downstream of said nips; a single sheet pocket comprising at least one partially split tubular member into which sheets can pass after having contacted said diverter; a corrugation nip positioned downstream of said diverter; and a low-rate linear compression spring means surrounding a portion of said sheet pocket for urging the sheets back towards either of said at least two sheet-feeder nips.

20. An inverter apparatus, including at least two sheet-feeder nips; diverter means having a pivot point thereof positioned downstream of said nips; a single sheet pocket comprising at least one partially split tubular member into which sheets can pass after having contacted said diverter means; and a low-rate linear compression spring means surrounding a portion of said sheet pocket for urging the sheets back towards either of said at least two nips.

* * * * *